US008602072B2

(12) United States Patent
Faulkner

(10) Patent No.: US 8,602,072 B2
(45) Date of Patent: Dec. 10, 2013

(54) DEVICE FOR FACILITATING TRANSFER OF A SUBSTANCE

(75) Inventor: Barry Faulkner, Sydney (AU)

(73) Assignee: ProMinent Fluid Controls Pty Ltd, Belrose, NSW (AU)

( * ) Notice: Subject to any disclaimer, the term of this patent is extended or adjusted under 35 U.S.C. 154(b) by 0 days.

(21) Appl. No.: 12/965,825

(22) Filed: Dec. 11, 2010

(65) Prior Publication Data

US 2012/0000576 A1 Jan. 5, 2012

(30) Foreign Application Priority Data

Dec. 14, 2009 (AU) ..... 2009906069

(51) Int. Cl.
*B65B 1/04* (2006.01)
*B65B 3/04* (2006.01)
*B65D 17/42* (2006.01)

(52) U.S. Cl.
USPC ..... 141/330; 141/89; 141/329; 141/383; 141/384; 222/83; 222/88; 137/68.29

(58) Field of Classification Search
USPC ..... 141/330, 329, 85, 89, 18, 383–384; 403/2, 44; 137/68.19, 68.21, 68.29; 222/81, 89, 91, 83, 88
See application file for complete search history.

(56) References Cited

U.S. PATENT DOCUMENTS

| | | | | |
|---|---|---|---|---|
| 4,614,437 | A * | 9/1986 | Buehler | 366/130 |
| 5,072,762 | A * | 12/1991 | Jimenez | 141/329 |
| 5,293,913 | A * | 3/1994 | Preszler | 141/367 |
| 6,935,493 | B2 * | 8/2005 | Cho | 206/222 |
| 6,974,024 | B2 * | 12/2005 | Cho | 206/219 |
| 6,976,606 | B2 * | 12/2005 | Anderson | 222/83 |
| 7,458,665 | B2 * | 12/2008 | Batista et al. | 347/85 |
| 2007/0181522 | A1 | 8/2007 | Davidson | |
| 2008/0029540 | A1 | 2/2008 | Johnson | |
| 2009/0120528 | A1 * | 5/2009 | Fisher et al. | 141/1 |

OTHER PUBLICATIONS

Examination report issued on Dec. 8, 2010 by the Intellectual Property Office of New Zealand for counterpart foreign patent application NZ 589654.

* cited by examiner

*Primary Examiner* — Timothy L Maust
*Assistant Examiner* — Timothy P Kelly
(74) *Attorney, Agent, or Firm* — David N. Lathrop

(57) ABSTRACT

A device facilitates the transfer of a substance from a container into a receptacle. The container has an opening sealed by a breachable seal. The device includes a connector for connection to the opening and a severing component. Either the connector or the severing component is movable with respect to the other to enable the severing component to breach the seal.

26 Claims, 7 Drawing Sheets

DEVICE FOR FACILITATING TRANSFER OF A SUBSTANCE

TECHNICAL FIELD

This invention broadly relates to a device for facilitating transfer of a substance from a container into a receptacle. In particular, the invention relates to a device enabling the substance to be transferred from the container into the receptacle in an enclosed environment.

BACKGROUND OF THE INVENTION

It is generally desirable in the chemical, pharmaceutical and water processing industry to provide a device capable of facilitating transfer of a toxic or poisonous substance from a sealed container to a receptacle for further processing without exposing the user to the toxic or poisonous substance.

It is an object of the present invention to provide a device which may facilitate transfer of the substance from the sealed container into the receptacle in an enclosed environment or which will at least provide a safe way of transferring the substance.

SUMMARY OF THE INVENTION

According to one aspect of the present invention, there is provided a device for facilitating transfer of a substance from a container into a receptacle, the container having an opening sealed by a breachable seal, the device including:

a connector for connection to the opening; and a severing means;

wherein one of the connector and the severing means being movable with respect to the other in order to enable the severing means to breach the seal.

The substance contained in the container may be toxic or poisonous and may be in the form of particulate such as particles or powder or in the form of a liquid or solution, or may be non-toxic.

The container is preferably in the shape of a cylindrical or rectangular bottle having an externally threaded neck, the opening of the container being sealed by a thermoplastic film. Alternatively, the container may be sealed by a tin or aluminium foil or other suitable breachable material.

In a preferred embodiment, the receptacle is a tank or reservoir. The tank or reservoir may contain a solvent in which the substance dissolves.

In this embodiment, it is preferred that the connector moves rather than the severing means. The severing means is preferably fixed at a predetermined position.

It is preferred that the connector is annular having a flanged portion and an anchoring portion. The flanged portion is preferred to be threaded on its internal bore so that in use it threadably engages a complementary thread on the neck of the container. Preferably, the anchoring portion is threaded on its external surface. The flanged portion is also preferred to include a handle whereby the connector may be manually rotated. Conveniently, rotation of the connector in a predetermined direction with respect to the coupler (and hence the fixed severing means) forces the seal of the container against the severing means thereby causing the severing means to breach the seal.

Preferably, the device also includes a coupler adapted to cooperate with the connector. The coupler is preferred to be a tubular sleeve including a flanged portion and a root portion. The flanged portion is threaded on its internal bore so as to in use threadably engage the anchoring portion of the connector.

The flanged portion may be configured such that it can be mounted or connected to the receptacle. The flanged portion is preferred to include an impeding means adapted to abut the handle of the flanged portion of the connector so as to restrict the rotation of the connector with respect to the coupler.

Preferably, the impeding means in this embodiment is positioned such that rotation of the connector to a full extent causes the severing means to the breach part of the seal only. As such, the breached seal may still be partially attached to the opening without falling into the receptacle.

The flanged portion in this embodiment is also preferred to include a removable stopper adapted in use to lock the connector in place with respect to the coupler so as to allow engagement and disengagement of the container to the connector. The removable stopper may be linked to the coupler by a tether such as a wire. The flanged portion is preferred to include an inlet adapted to be connected to a water supply.

In a preferred embodiment, the root portion of the coupler includes a circumferential cavity being open at one end and having one or more outlets at another end. Preferably, the cavity is in communication with the inlet of the flanged portion. The outlets are configured and located such that the water supplied through the inlet is discharged towards an interior of the container for rinsing purposes.

The device may include a retainer adapted to be fitted onto the root portion of the coupler to close off the open end of the cavity. The open end of the cavity may include an enlarged portion for accommodating a sealing means for preventing leakage. The sealing means is preferred to be an O-ring.

Preferably, the severing means is in the form of a blade. More preferably, the severing means is affixed to the coupler via a bracket.

In a preferred embodiment, the container threadably engages the connector with the container in an inverted position. This causes the substance within the container to automatically fall out of the container into the receptacle under gravity. It is however anticipated that the container may engage the connector in other orientations.

It is intended that the device of the present invention may be used to enable the transfer of the substance to be conducted in an enclosed environment without exposing a user to the substance which may be toxic, poisonous or hazardous to health.

BRIEF DESCRIPTION OF THE DRAWINGS

The invention may be better understood from the following non-limiting description of a preferred embodiment, in which.

DETAILED DESCRIPTION

Figure 1:
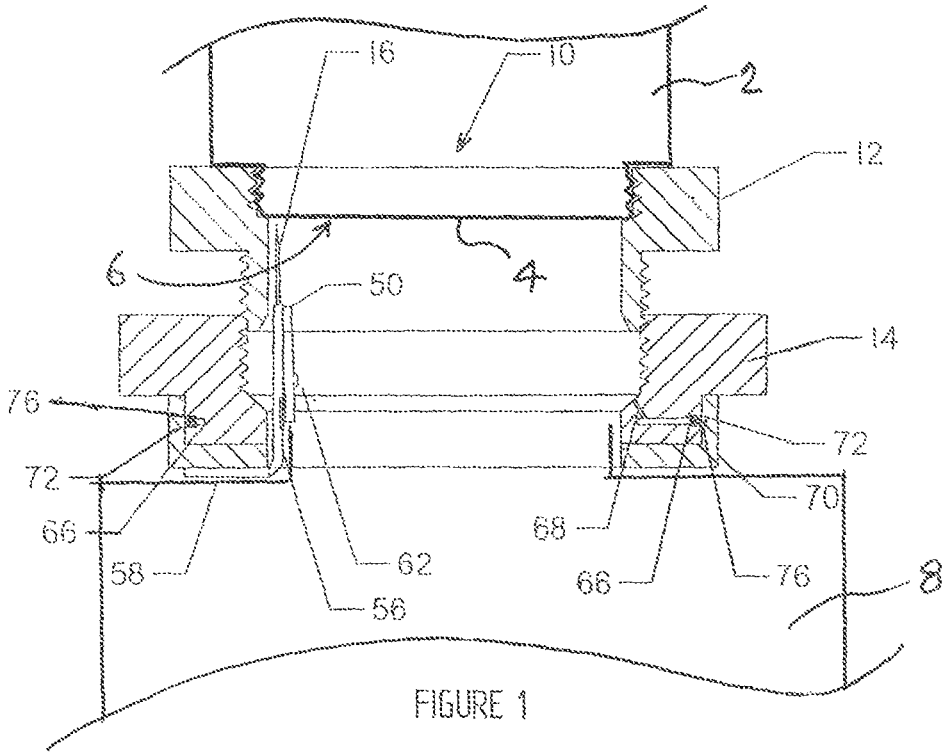
FIG. 1 is a cross sectional view of a device in accordance with the preferred embodiment of the present invention being connected to a container.

Referring to FIG. 1, a device 10 for facilitating transfer of a substance (not shown) from a container 2 into a receptacle 8 includes a connector 12 and a coupler 14. It is anticipated that the substance contained in the container is typically toxic or poisonous in the form of particulate, particle or powder which can be air borne. The container 2 typically is in the shape of a cylindrical or rectangular bottle having an externally threaded neck defining an opening 6. For health and safety reasons, the opening 6 is sealed by a breachable seal 4 which is made of a customised thermoplastic film.

The connector 12 is screwed onto the coupler 14 in the assembly of the device 10. The connector 12 also serves the purpose of connecting the container to the opening 6. The device also includes a severing means in the form of a blade 16 for breaching the seal. The blade 16 will be discussed further below.

Figure 2:
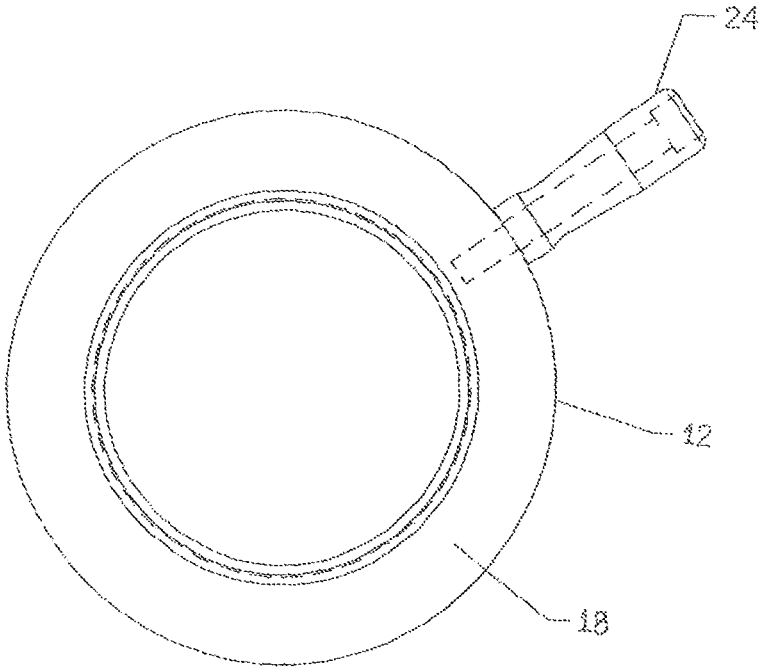
FIG. 2 is a plan view from above of a connector of the device of FIG. 1.
Figure 3:
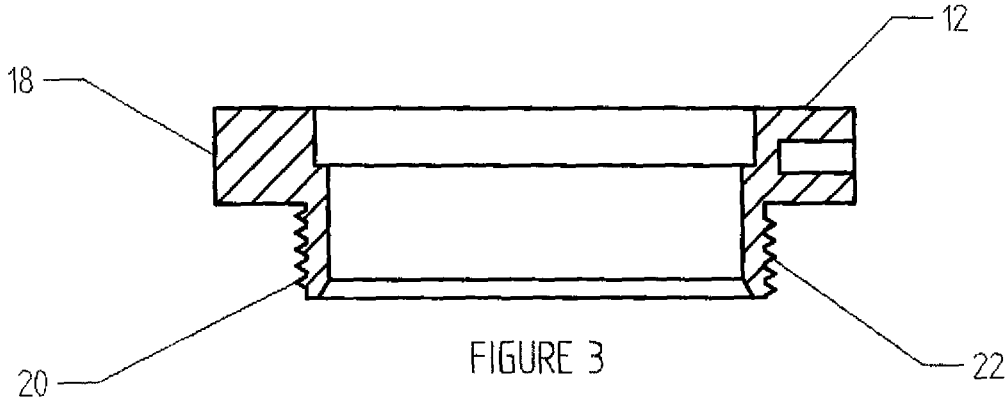
FIG. 3 is a cross sectional view of the connector of FIG. 2.
Figure 4:
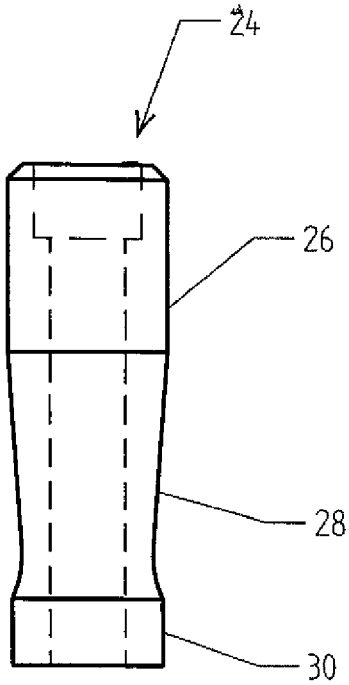
FIG. 4 is a side view of the handle which in use is joined to the connector of FIG. 2.

As best shown in FIGS. 2 and 3, the connector 12 is annular in shape having a flanged portion 18 and anchoring portion 20. The flanged portion 18 is threaded on its internal bore so that it threadably engages a complementary thread 19 on the neck of the container. The anchoring portion 20 is threaded on its external surface 22. The flanged portion 18 also includes a handle 24 as shown in FIGS. 2 and 4 for allowing the connector 12 to be rotated manually. Referring to FIG. 4, the handle 24 has a tapering section 28 joining an end 26 and a base 30.

Figure 5:
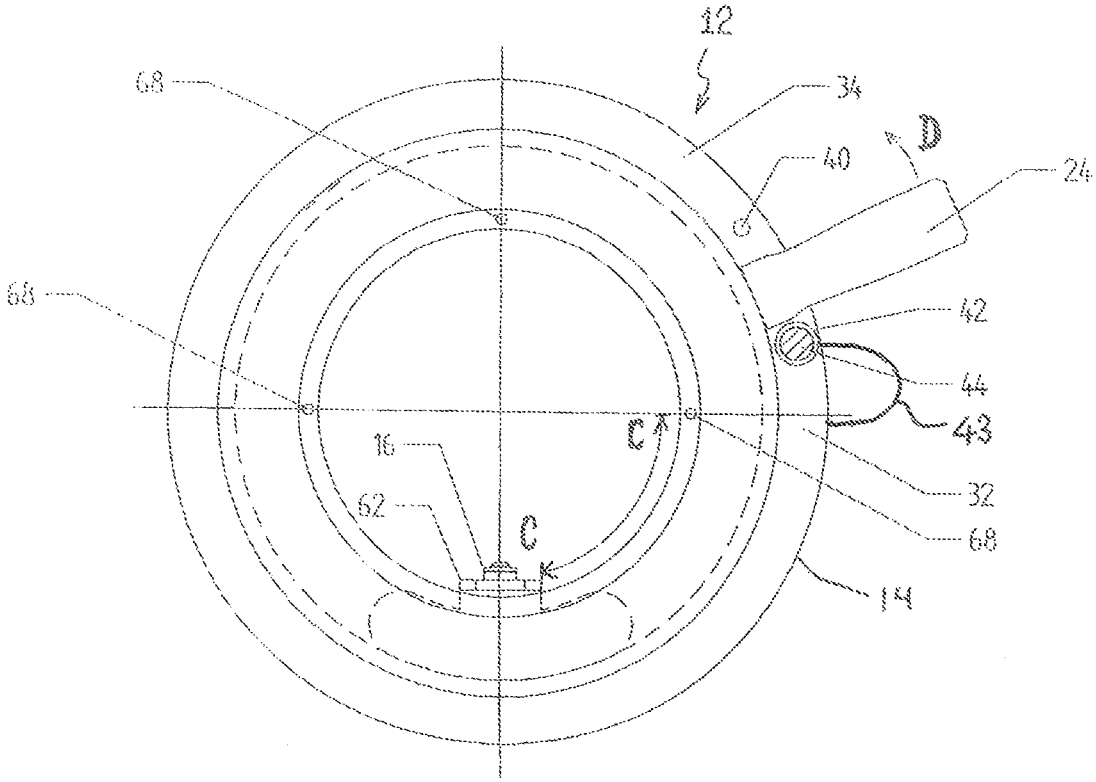
FIG. 5 is a plan view from top of the device of FIG. 1.
Figure 7:
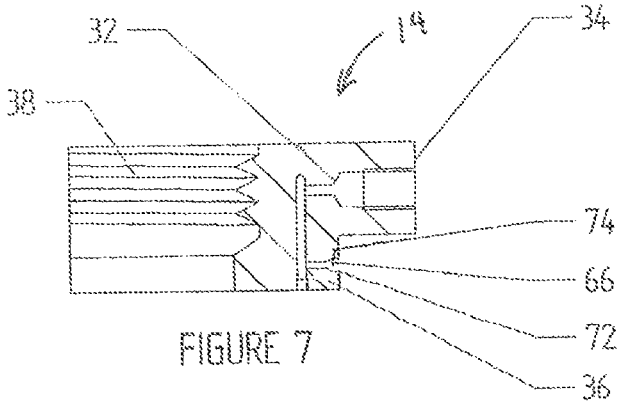
FIG. 7 is a cross sectional view of the coupler taken from line B-B of FIG. 6.
Figure 6:
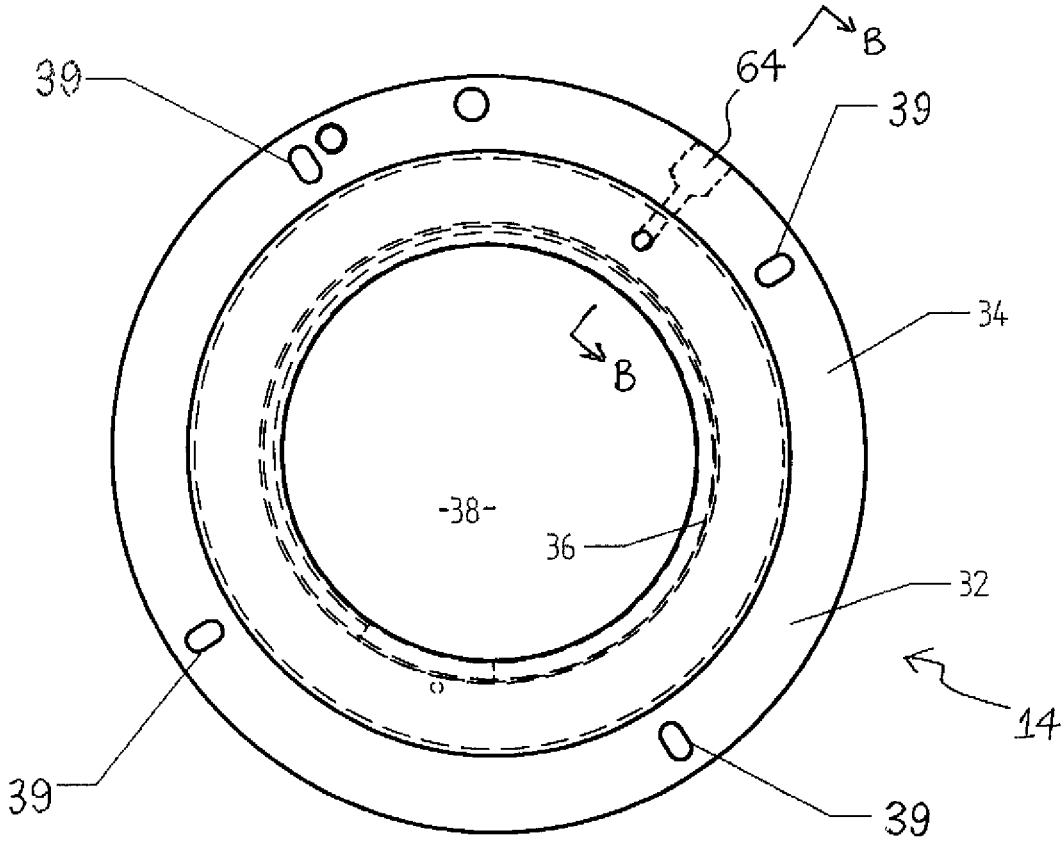
FIG. 6 is a plan view from below of a coupler of the device of FIG. 1.

Turning to FIGS. 5 to 7, the coupler 14 is designed to cooperate with the connector 12 providing a closed environment. The coupler 14 has a tubular sleeve 32 including a flanged portion 34 and a root portion 36. The flanged portion 34 is threaded on its internal bore 38 so as to threadably engage the anchoring portion 20 of the connector 12. The flanged portion 34 is configured such that it can be mounted onto the receptacle by fixing means. As best shown in FIG. 6, the flanged portion 20 has holes 39 for receiving fixing means such as bolts or screws to secure the coupler 14 onto the receptacle.

Referring back to FIG. 5, the flanged portion 34 has two apertures 40 and 42. The aperture 42 is provided to receive the bottom part of a vertically disposed impeding means 44. When the connector 12 is rotated to where the impeding means 44 is located, the connector 12 abuts the exposed part of the impeding means 44 thereby restricting the rotation of the connector 12 with respect to the coupler 14.

Figure 8:
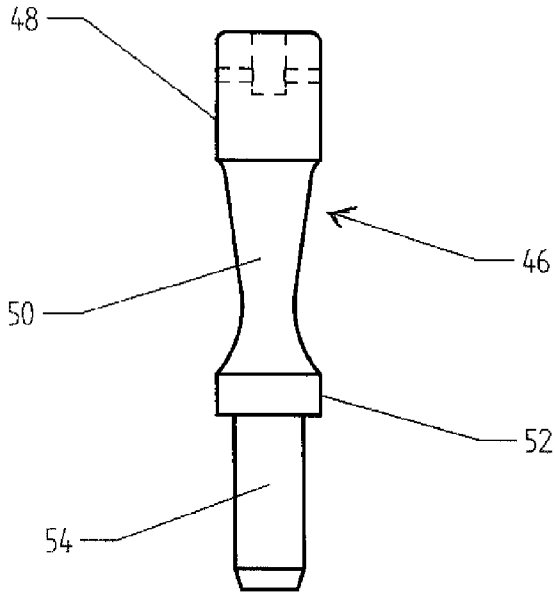
FIG. 8 is a side elevation of a stopper which in use cooperates with the coupler of FIG. 6.

The flanged portion 34 is also connected to a removable stopper 46 (see FIG. 8) via a wire (not shown). The stopper 46 has a knob 48 connected to a tapering shaft 50 which ends with a projecting rim 52. The stopper 46 also includes a downwardly extending section 54 which in use is received within the aperture 40. In order to engage or disengage the container from the flanged portion 18 of the connector 12, the stopper 46 is inserted into the aperture 40 after the handle 24 is rotated to a position where it abuts the impeding means 44. This means that the handle 24 is sandwiched between the impeding means 44 and the stopper 46, resulting in the connector being locked in position. The container can then be engaged with or disengaged from the flanged portion 18 by rotational movement. As shown in FIG. 5, the stopper 46 is linked to the coupler 14 by a tether in the form of a wire 43.

Figure 9:
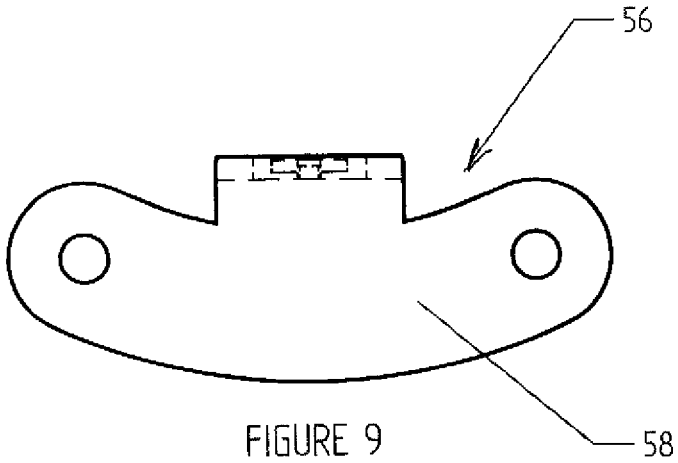
FIG. 9 is a end view from below of a bracket which in use is connected to the coupler of FIG. 6.
Figure 10:
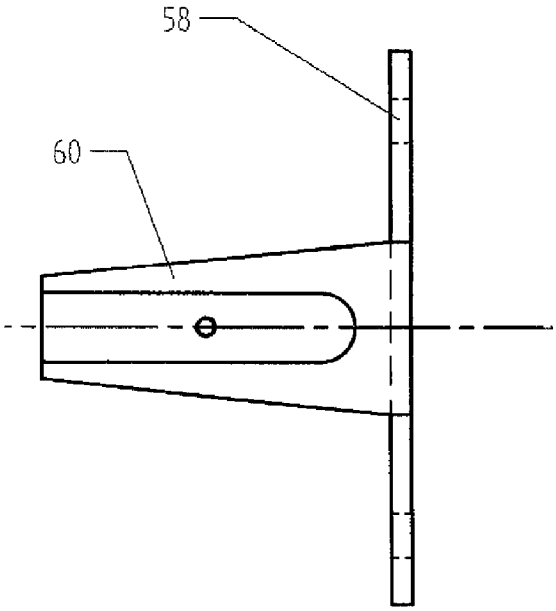
FIG. 10 is a plan view of the bracket of FIG. 9.
Figure 11:
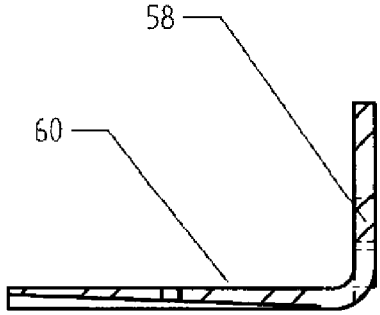
FIG. 11 is a side view of the bracket of FIG. 9.
Figure 12:
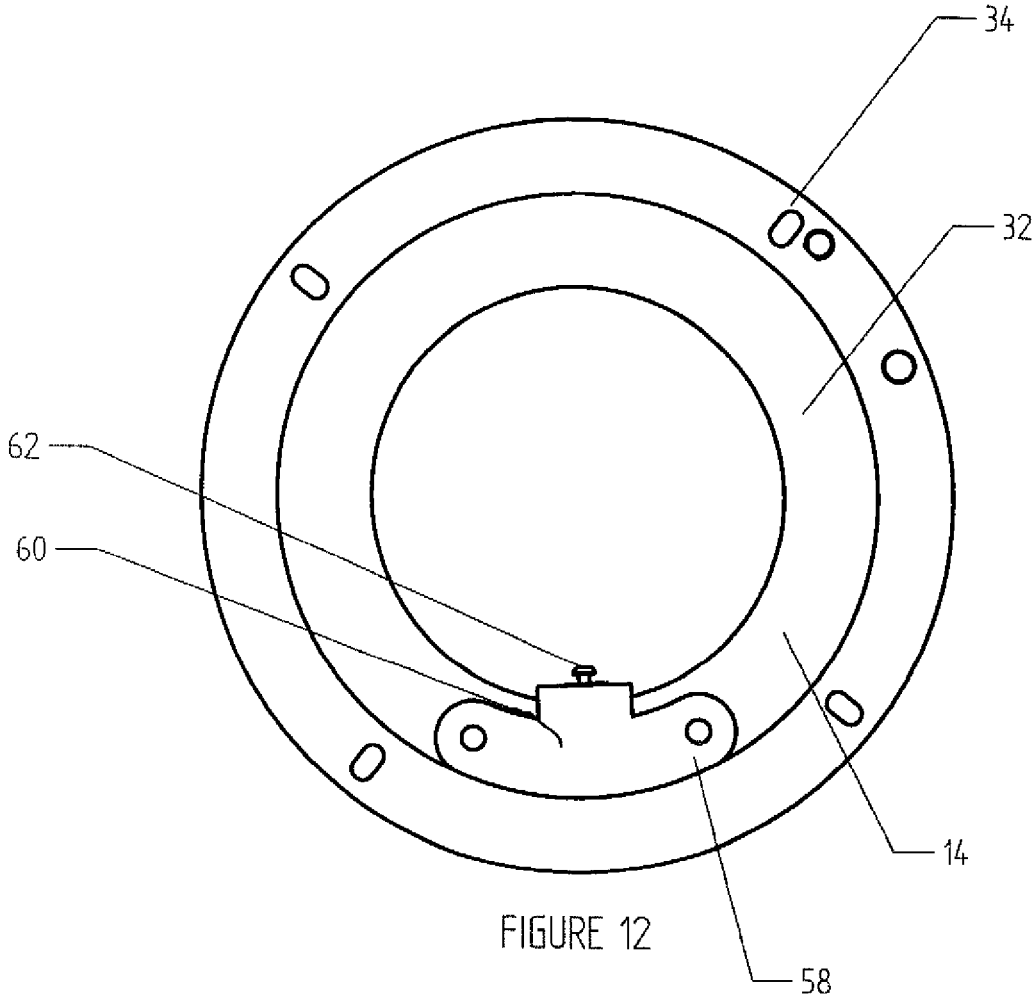
FIG. 12 is a plan view from below of the device of and FIG. 1.

Referring back to FIG. 1, the coupler 14 includes a bracket 56 adapted to hold the blade 16. As shown in FIGS. 9 to 11, the bracket 56 is L-shaped having a sleeve 60 and a base plate 58. The base plate 58 is kidney-shaped and affixed to the underside of the coupler 14, as shown in FIG. 12. The sleeve 60 extends upwardly (see FIG. 1) and includes a rivet 62 for securing the blade 16 in position. The blade 16 is partially embedded in the sleeve 60. The exposed part of the blade 16 is located such that when the connector 12 rotates downwardly in an anticlockwise direction engaging the coupler 14, the seal of the container is brought into contact and forced against the blade 16 thereby effecting breach of the seal.

Referring to FIG. 5, it can be seen that there is a gap indicated by C-C between the blade 16 and the impeding means 44. The blade 16 has a cutting edge 62. This configuration and arrangement means that rotation of the connector 12 to a full extent in an anticlockwise direction causes the blade 16 to breach only about three-quarter of the seal, as the impeding means 44 prevents the handle 24 from rotating further. This is advantageous in that the breached seal is still attached to the opening of the container without falling into the receptacle. The size of the gap (C-C) is adjustable by moving the bracket 56 carrying the blade 16, as desired by the user.

As shown in FIG. 6, the flanged portion 34 has an inlet 64 which is connected to a water supply. Referring now to FIGS. 1 and 5, the root portion 36 of the coupler 14 includes a circumferential cavity 66 which is open at one end 72 and joined at the another end to three outlets 68 at three different locations 68. The cavity 66 is in communication with the inlet 64 of the flanged portion 34. The outlets 68 are configured and located such that the water supplied through the inlet 64 is discharged towards the interior of the container for rinsing purposes.

Figure 13:
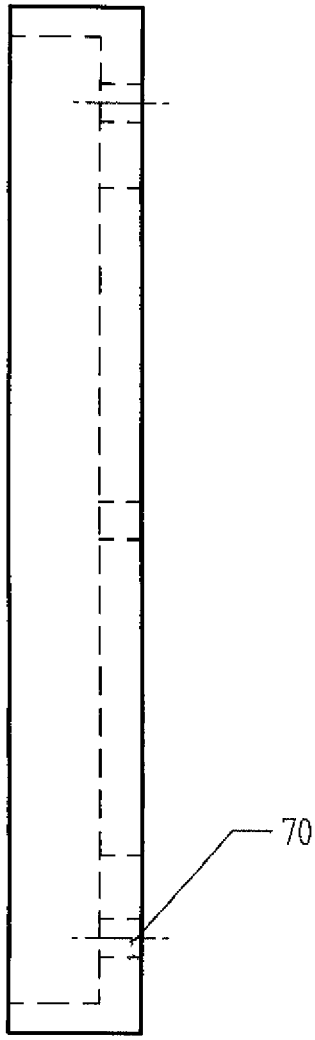
FIG. 13 is a cross sectional view of a retainer being a component of the device of FIG. 1.

Referring to FIGS. 1 and 13, the device 10 also includes a retainer 70 which is fitted onto the root portion 36 of the coupler 14 for closing off the open end 72 of the cavity 66. As best shown in FIG. 1, the open end 72 of the cavity 66 includes an enlarged portion 74 for accommodating a sealing means in the form of an O-ring 76 for preventing water leakage.

The operation of the device is as follows. The container is inverted so that the opening faces down. The threaded neck of the container is then brought into engagement with the connector 12 by rotational movement. The stopper 46 is removed from the aperture 40 so as to allow the handle 24 to be moved freely. The connector 12 is rotated by moving the handle 24 in an anticlockwise direction (as indicated by the arrow D in FIG. 5) to a full extent such that the handle ends up abutting an opposing side of the stopper 46. Rotation of the connector 12 effectively causes the blade 16 to breach the majority of the seal along the circumferential edge of the opening of the container. As a result, the substance within the container automatically falls out of the container into the receptacle under gravity.

Once the container has been emptied, water (or any other chosen rinsing liquid or solution) is jetted through the inlet 64 into the interior of the container for rinsing purposes. To remove the container, the above steps simply have to be reversed.

Now that a preferred embodiment of the present invention has been described in some detail, it will be apparent to a skilled person in the art that the device of the present invention may offer at least the following advantages:

1. it enables the transfer of the substance to be conducted in a closed environment without exposing a user to the substance which may be toxic, poisonous or hazardous to health;

2. it is easy to install and operate; and
3. it is applicable to many different industries which involve handling or manipulating of particulate or powder-like substance.

Those skilled in the art will appreciate that the invention described herein is susceptible to variations and modifications other than those specifically described. For instance, it is contemplated that the present invention may be used for containers containing any particulate or powder-like chemicals such as washing powder. Also, the device may be designed such that breaching of the seal may be effected by having the connector remain in the same position while the blade rotates as the coupler moves. Furthermore, the coupler and connector may be disposed horizontally or at an angle to one another to suit a different substance transferring mechanism. The containers may have a seal made in a tin or aluminium foil or other suitable breachable or frangible materials. Also, the substance may also include a liquid or solution. All such variations and modifications are to be considered within the scope and spirit of the present invention the nature of which is to be determined from the foregoing description.

The invention claimed is:

1. A device for facilitating transfer of a substance from a container into a receptacle, the container having an opening sealed by a breachable seal, the device comprising:

a connector for connection to the opening, wherein the connector is annular having a first flanged portion and an anchoring portion, and wherein the first flanged portion includes a handle whereby the connector is rotatable;

a coupler adapted to cooperate with the connector, wherein the coupler is a tubular sleeve including a second flanged portion and a root portion;

a severing means; and an impeding means operatively associated with the severing means;

wherein one of the connector and the severing means is movable with respect to the other in order to enable the severing means to breach the seal and relative movement of the connector or severing means is restricted by the impeding means, and wherein the second flanged portion includes the impeding means adapted to abut the handle so as to restrict rotation of the connector with respect to the coupler.

2. The device of claim 1, wherein the substance contained in the container is in the form of particulate such as particles or powder or in the form of a liquid or solution.

3. The device of claim 1, wherein the opening of the container is sealed by at least one of the following: a thermoplastic film, a tin foil, an aluminium foil or other suitable breachable material.

4. The device of claim 1, wherein the receptacle is a tank or reservoir containing a solvent in which the substance dissolves.

5. The device of claim 1, wherein in use, the connector is moved whilst the severing means is fixed at a predetermined position.

6. The device of claim 1, wherein the first flanged portion is threaded on its internal bore so that in use it threadably engages a complementary thread on a neck of the container.

7. The device of claim 1, wherein the anchoring portion is threaded on its external surface.

8. The device of claim 1, wherein the first flanged portion includes a handle whereby the connector is rotatable.

9. The device of claim 1, wherein rotation of the connector in a predetermined direction with respect to the coupler forces the seal of the container against the severing means thereby causing the severing means to breach the seal.

10. The device of claim 1, wherein the second flanged portion is threaded on its internal bore so as to in use threadably engage an anchoring portion of the connector.

11. The device of claim 1, wherein the second flanged portion is configured such that it is capable of mounting or being connected to the receptacle.

12. The device of claim 1, wherein the impeding means is positioned such that rotation of the connector to a full extent causes the severing means to breach part of the seal only.

13. The device of claim 1, wherein the impeding means is positioned such that rotation of the connection to a full extent results in the breached seal being still partially attached to the opening without falling into the receptacle.

14. The device of claim 1, wherein the second flanged portion includes a removable stopper adapted in use to lock the connector in place with respect to the coupler so as to allow engagement and disengagement of the container to the connector.

15. The device of claim 14, wherein the removable stopper is linked to the coupler by a tether.

16. The device of claim 1, wherein the second flanged portion includes an inlet adapted to be connected to a water supply.

17. The device of claim 1, wherein the root portion of the coupler includes a circumferential cavity being open at one end and having at least one outlet at another end.

18. The device of claim 17, wherein the second flanged portion includes an inlet adapted to be connected to a water supply and the cavity is in communication with the inlet of the second flanged portion.

19. The device of claim 17, wherein the second flanged portion includes an inlet adapted to be connected to a water supply and the at least one outlet is configured and located such that the water supplied through the inlet is discharged towards an interior of the container.

20. The device of claim 17, which includes a retainer adapted to be fitted onto the root portion of the coupler to close off the open end of the cavity.

21. The device of claim 17, wherein the open end of the cavity includes an enlarged portion for accommodating a sealing means for preventing leakage.

22. The device of claim 21, wherein the sealing means is an O-ring.

23. The device of claim 1, wherein the severing means is in the form of a blade.

24. The device of claim 1, wherein the severing means is affixed to the coupler via a bracket.

25. The device of claim 1, wherein the container threadably engages the connector with the container in an inverted position.

26. The device of claim 1, wherein the container engages the connector with the container in such a position that results in the substance within the container automatically falling out of the container into the receptacle.

* * * * *